US007047901B2

(12) United States Patent
Chen

(10) Patent No.: US 7,047,901 B2
(45) Date of Patent: May 23, 2006

(54) MOTORIZED HYDROFOIL DEVICE

(76) Inventor: Shane Chen, 1821 NW. Eight Ave., Camas, WA (US) 98604

( * ) Notice: Subject to any disclaimer, the term of this patent is extended or adjusted under 35 U.S.C. 154(b) by 0 days.

(21) Appl. No.: 10/347,507

(22) Filed: Jan. 17, 2003

(65) Prior Publication Data

US 2004/0139905 A1 Jul. 22, 2004

(51) Int. Cl.
*B63B 1/28* (2006.01)

(52) U.S. Cl. ..... 114/281; 114/274

(58) Field of Classification Search ..... 440/6; 114/274–282, 55.56; 441/74, 79, 65
See application file for complete search history.

(56) References Cited

U.S. PATENT DOCUMENTS

| | | | | | |
|---|---|---|---|---|---|
| 857,951 | A * | 6/1907 | Meacham | 114/281 |
| 2,593,806 | A * | 4/1952 | Steele | 114/55.56 |
| 2,931,332 | A * | 4/1960 | Hebrank | 114/55.54 |
| 3,456,613 | A * | 7/1969 | Smith | 440/6 |
| 3,465,704 | A * | 9/1969 | Baker | 114/276 |
| 3,650,234 | A * | 3/1972 | Goudy | 114/315 |
| 3,722,450 | A | 3/1973 | Arimura | |
| 4,349,340 | A | 9/1982 | Hoffmann | |
| 4,711,195 | A * | 12/1987 | Shutt | 114/274 |
| 4,972,792 | A * | 11/1990 | Yokoyama et al. | 114/275 |
| 5,083,948 | A * | 1/1992 | Grobson | 440/49 |
| 5,117,776 | A | 6/1992 | Thrope | |
| 5,136,961 | A * | 8/1992 | Follett | 114/274 |
| 5,362,264 | A * | 11/1994 | Parant | 440/29 |
| 5,413,066 | A * | 5/1995 | Spencer, Jr. et al. | 114/354 |
| 5,448,963 | A | 9/1995 | Gallington | |
| 5,471,942 | A | 12/1995 | Miller et al. | |
| 6,178,905 | B1 * | 1/2001 | Dynes et al. | 114/55.54 |
| 6,409,560 | B1 * | 6/2002 | Austin | 441/74 |
| 6,468,118 | B1 | 10/2002 | Chen | |

* cited by examiner

*Primary Examiner*—Ed Swinehart
(74) *Attorney, Agent, or Firm*—Steven J. Adamson

(57) ABSTRACT

A motorized hydrofoil water craft that has a substantially horizontally disposed flotation device that may be configured to receive an adult human in a prone, sitting or standing position. The craft includes a hydro foil, a motor, and a steering mechanism. The hydrofoil may have various configurations and be detachable, while the motor may be electric and have an associated battery that is situated underwater in use. The steering mechanism may include a canard and be configured for vertical movement of the canard. Several embodiments are disclosed.

24 Claims, 4 Drawing Sheets

MOTORIZED HYDROFOIL DEVICE

FIELD OF THE INVENTION

The present invention relates to a personal water craft and, more specifically, to a motorized hydrofoil based water craft.

BACKGROUND OF THE INVENTION

The prior art comprises many types of personal water crafts including row boats, paddle-wheel devices, jet skis, sailboards, and others. While many of these craft provided a particular benefit they also have disadvantageous aspects. Disadvantageous aspects may including that they are undesirably heavy or cumbersome for ready transport and use by a person (unaided by others or by machinery). Other disadvantageous aspects include excessive costs or a relatively high level of operator ability for successful operation.

The personal water craft prior art also includes hydrofoil devices. Exemplary prior art hydrofoil devices include those disclosed in U.S. Pat. Nos. 6,468,188; 6,178,905; 5,471,942; 5,448,963; 5,117,776; 4,711,195; 4,349,340; and 3,722,450. These include boat-like devices, jet ski and sailboard like devices and various other devices. U.S. Pat. No. 6,178,905 discloses a hydrofoil water craft that is disadvantageous, among other reasons, in that it provides limited operator positioning, a relatively bulky motor arrangement and limited maneuverability (for example, an operator cannot contrl lift of the front foil). U.S. Pat. No. 5,471,942 discloses a hydrofoil sailboard that is disadvantageous, among other reasons, in that it requires significant user aptitude for operation and provides limited maneuverability.

A need thus exists for a personal water craft that overcomes the limitations of the prior art. A need also exists for a personal water craft that more readily affords a "surfing" experience and one that provides enhanced performance, ease of use and transport, and is relatively inexpensive to make, use and maintain.

SUMMARY OF THE INVENTION

The present invention overcomes the shortcomings of the prior art and beneficially contributes to the hydrofoil and water craft arts.

The present invention may include a motorized hydrofoil water craft that has a substantially horizontally disposed flotation device that is longer than wide and configured to receive an adult human. The craft may include a hydrofoil, a motor, and a steering mechanism.

In one aspect, the flotation device may configured to receive a human in a prone, sitting or standing position. In another aspect, the hydro foil may have various configurations and be detachable. In yet another aspect, the motor may be electric and have an associated battery that is situated underwater in use. And in yet another aspect, the steering mechanism may include a canard and be configured for vertical movement of the canard.

The attainment of the foregoing and related advantages and features of the invention are achieved by use of a motorized hydrofoil apparatus as described herein and should be more readily apparent to those skilled in the art, after review of the following more detailed description of the invention taken together with the drawings.

DETAILED DESCRIPTION

Figure 1:
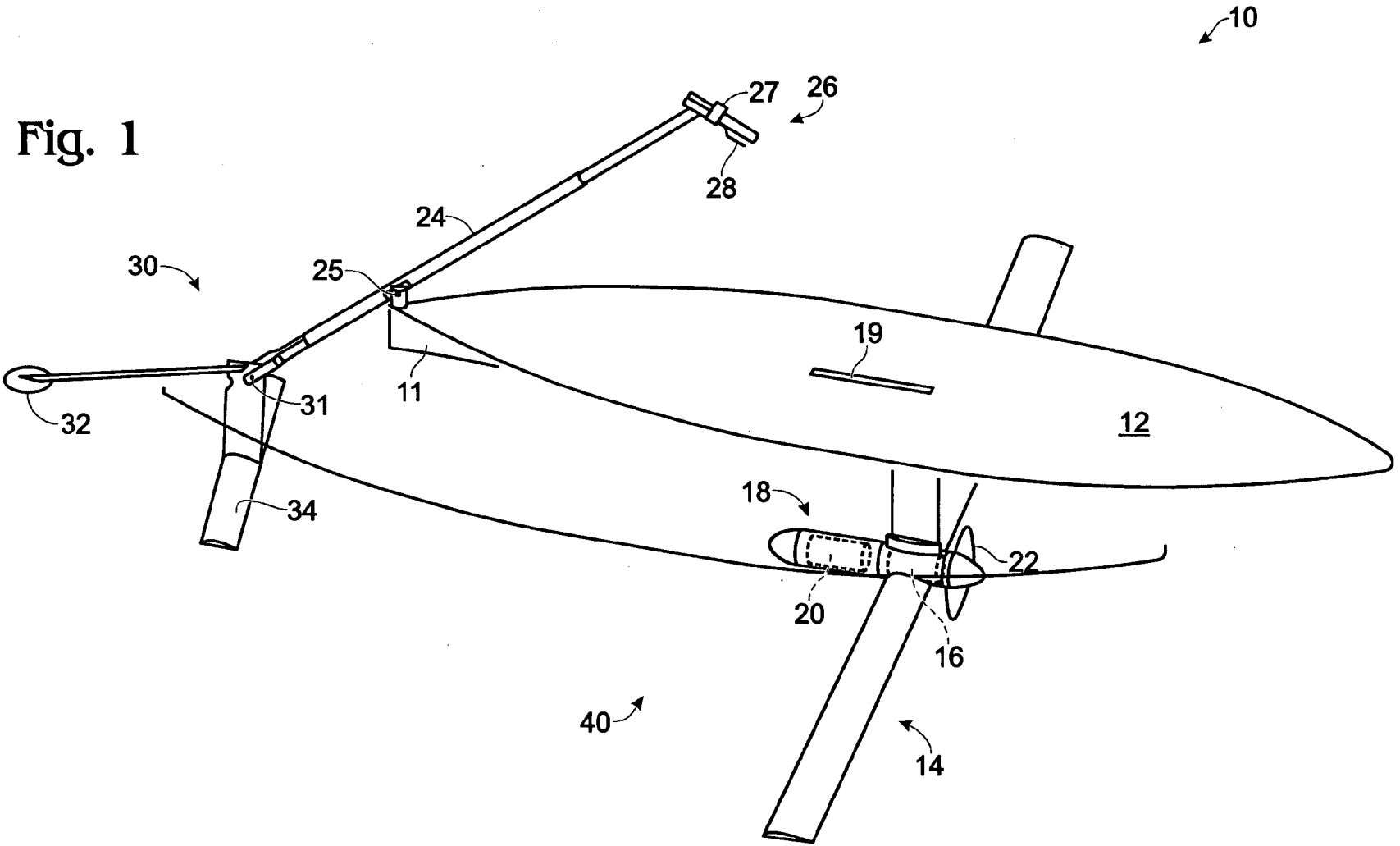
FIG. 1 is a perspective view of a hydrofoil water craft in accordance with the present invention.

Referring to FIG. 1, a perspective view of a hydrofoil water craft 10 in accordance with the present invention is shown. Craft 10 may include a board 12, a hydro foil or wing 14, a motor 16, a battery or other power source 20, a propeller 22, a steering shaft 24 and a canard 30. Note that motor 16 and battery 20 are provided in housing 18 in a manner that reduces drag.

Board 12 is preferably a foam core or related board, though it may be made or other materials and configurations that provide flotation. Material examples include, but are not limited to, plastic, metal, wood fiberglass and other materials. Flotation may be provided by displacement or trapped air, etc.

Board 12 of FIG. 1 is similar in some aspects to that used in surfing and/or sailboarding. The board is preferably longer than wide and may be more than twice as long as wide. Board 12 may be configured to provide a relatively flat surface (as shown in FIG. 1) that receives an adult human in a prone, sitting or standing position. In an alternative embodiment, flotation 12 may take the form of an open or closed shell kayak or other arrangement.

The bow of board 12 may taper to form a linear or vertical front which may in turn initiate a small keel 11 (as shown in FIG. 1). Board 12 may contain a central slot or other configuration for the detachable reception of foil assembly 40, discussed in more detail below.

The steering shaft may have a telescoping configuration (to accommodate different size users), and have a control handle 26 provided at a user end and a canard 30 provided at the distal end. The canard includes a spoon 32 and a relatively small foil 34. Spoon 32 senses the water surface and small foil 34 provides support, permitting the canard to lock onto the water surface. Canard 30 is preferably coupled to shaft 24 by pivot 31 or by another mechanism.

Steering shaft 24 may be coupled to board 12 by a universal pivot 25. Universal pivot 25 permits a user to turn shaft 24 left, right, up, and down and various combinations thereof. Movement of shaft 24 to the left (from the perspective of a user) causes craft 10 to turn to the right, and vice versa.

Shaft 24 may be configured to extend beyond board 12 a sufficient distance to permit operator adjustment of the height of the canard. This may be of particular relevance when encountering a wave or a ship wake, or other water turbulence.

Control handle 26 may include an on-off switch 27 and a throttle lever 29. With the on-off switch turned on, a user pulls in throttle lever 29 which causes motor 16 to turn propeller 22. The further the handle is pulled in, the faster the craft goes. When the throttle is released, the motor and propeller stop.

Figure 4:
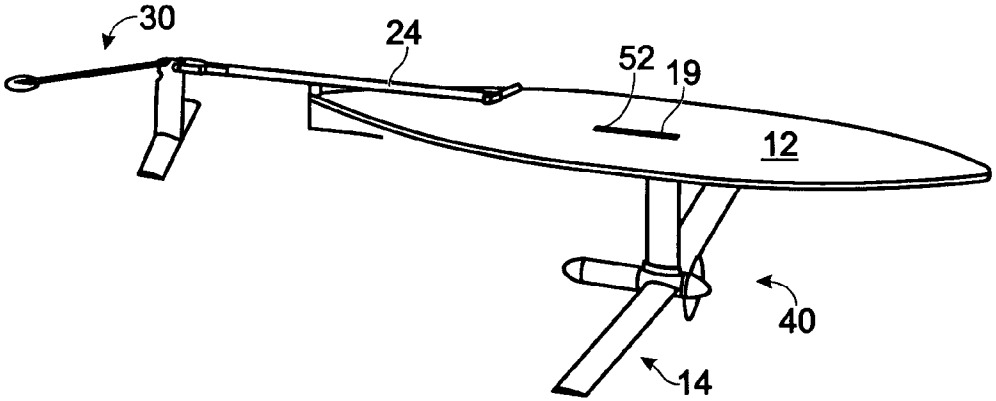
FIG. 4 is a perspective view of the water craft of FIG. 1 in a starting (or ending) position in accordance the present invention.

To operate craft 10, a user initially lays on board in a prone position and engages the motor. Note that more experienced user may begin use from a sitting or standing position. When in a prone position, shaft 24 may be positioned in a substantially horizontal manner as shown in FIG. 4. An operator is able to control speed and direction through handle 26. As the craft gains speed and the board becomes more stable, a user may readily stand on the board and assume as desired position which may include a "surfing" style position. With sufficient speed the board raises out of the water riding primarily on foil 14. Should a user jump or fall off the craft, the user simply releases the throttle lever causing the motor to stop. For a more controlled stop, the user can throttle down gradually.

Figure 2:
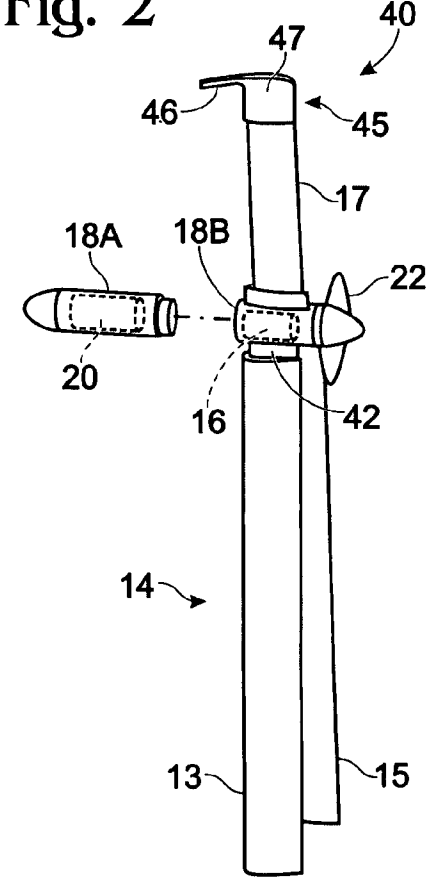
FIG. 2 is a perspective, exploded view of one embodiment of a foil assembly in accordance with the present invention.

Referring to FIG. 2, a perspective, exploded view of one embodiment of foil assembly 40 in accordance with the present invention is shown. FIG. 2 illustrates a foldable version of foil 14. In this embodiment, foil 14 is comprised of two foil sections 13 and 15 that are respectively coupled by hinges 42 to housing 18. Due to lift induced during forward movement of the foil and/or due to a buoyant composition, foil sections 13, 15 rise in water to the position shown in FIG. 1. The range of motion of hinges 42 is such that upward movement of sections 13, 15 stops at a desired position shown in FIG. 1.

FIG. 2 also illustrates housing 18 separated into component parts 18A and 18B. Part 18A houses battery 20, while part 18B houses electric motor 16. Housing parts 18A, 18B are preferably made of aluminum or a suitable alloy. Metallic or like materials provide good thermal conductivity for cooling motor 16. Parts 18A, 18B are preferably coupled in a releasable manner with an o-ring or other mechanism to form a watertight seal.

While battery 20 may be provided elsewhere, such as in a cavity in the board, providing the battery as shown in FIG. 2 achieves several benefits. These benefits include that the board is rendered lighter and thus more maneuverable, the battery is located in the same housing as the motor making the battery easier to change, and the necessity of running wires from the board to the motor is eliminated.

The motor 16 may be a DC motor or other suitable motor. The battery 20 may be a nickel metal hydride battery or other suitable battery. Note that while a battery and motor are preferred, a gasoline engine or the like could be used as an alternative. The gas engine would preferably be provided on board 12 and drive propeller 22 by a rigid or flexible shaft arrangement. Note also that as fuel cells reach a suitable level of development, they may be used in place of motor 16.

Foil 14 and housing 18 are suspended below the board by vertical spacer 17. Vertical spacer 17 may maintain the foil (and propeller) at a desired distance from the board. Design considerations in determining foil depth include providing sufficient space between the board and the water surface so that a user can execute a turn without the board coming in contact with the water surface.

A top portion 45 of vertical spacer 17 is configured for releasably coupling to board 12. The top portion includes a tab 46 and a pin hole 47. To mount the foil assembly to the board, top portion 45 is inserted into slot 19 in such a manner that tab 46 engages complementary geometry in slot 19. A releasable pin is provided through portions of board 12 (or a bracket coupled to board 12) and pin hole 47 to releasably securely the foil assembly to the board. Note also that the vertical spacer may be fixedly coupled to the board. This, for example, may be utilized in the embodiment of FIG. 5 in which foil 14 is detachable from the vertical spacer.

Figure 3:
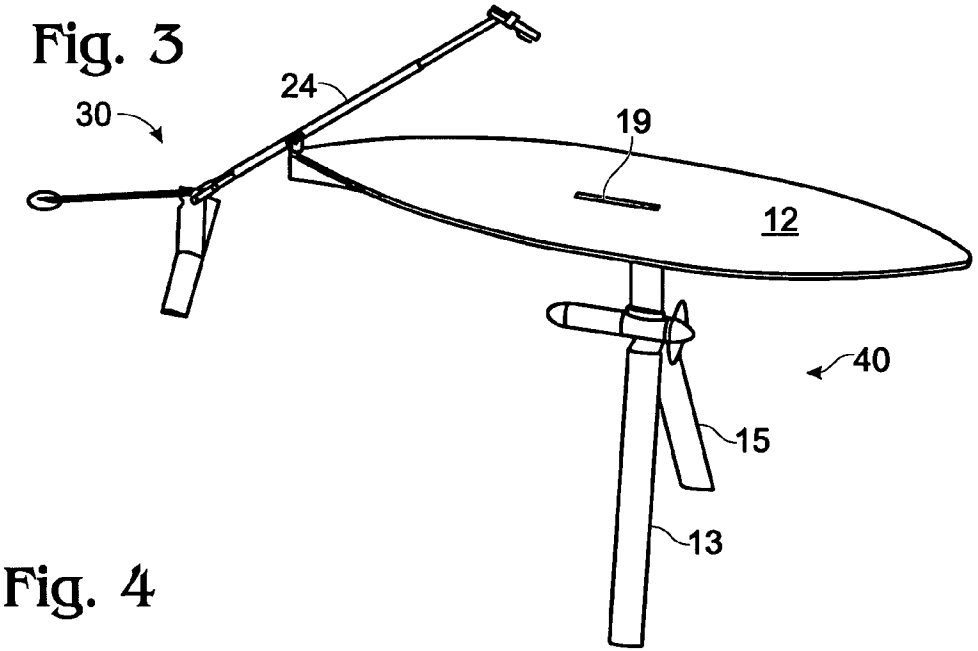
FIG. 3 is a perspective view of the water craft of FIG. 1 in setup or in-use in accordance the present invention.

Referring to FIG. 3, a perspective view of craft 10 in setup or in use in accordance the present invention is shown. FIG. 3 illustrates foil assembly 40 inserted into slot 19 and foil sections 13 and 15 positioned at some point between vertical and horizontal. This perspective may represent several situations. In one, the foil sections are buoyant and rising after being placed in the water. In another, the craft is moving forward causing the foils to lift. In yet another, the boat is stopped or stopping and the foils are not buoyant and are descending.

Referring to FIG. 4, a perspective view of craft 10 in a starting (or ending) position in accordance the present invention is shown. This position is characterized by shaft 24 being provided in a nearly horizontal position laying on the fore-deck of board 12.

FIG. 4 also illustrates angle-of-attack adjustment knob 52. Knob 52 and slot 19 are configured such that knob 52 can be pulled backward in releasable increments that move tab 46 upward causing foil assembly 40 to pivot around the pin in pin hole 47. This in turn moves the bottom of the vertical spacer forward increasing the angle-of-attack of the attached foil. Note that in another embodiment of adjusting the angle-of-attack of foil 14, an adjustable mechanism such as one using wing nuts or the like, for example, could be provided where foil 14 couples to housing 18 or vertical spacer 17.

Figure 5:
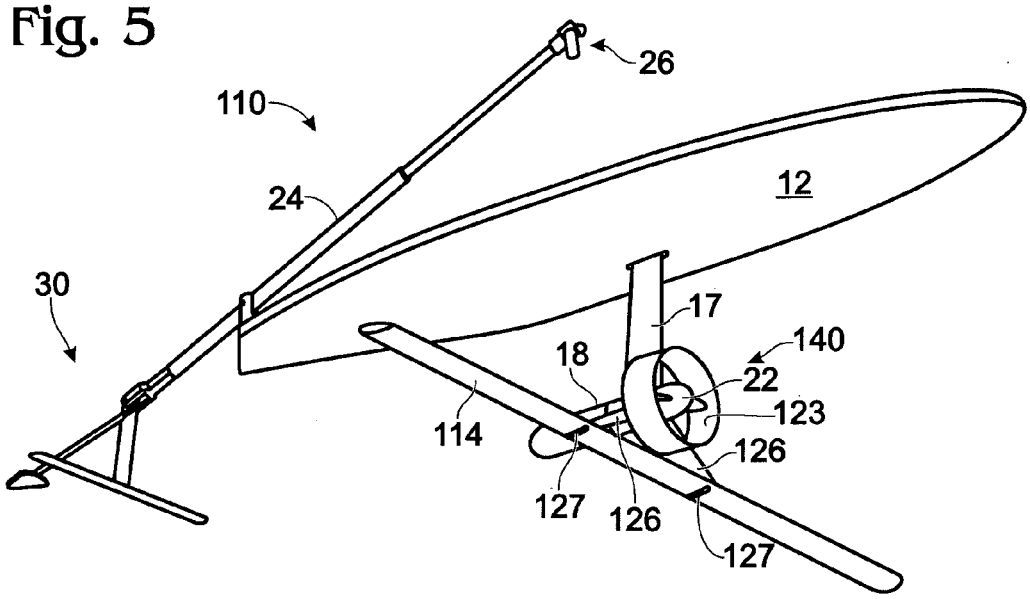
FIG. 5 is a perspective bottom view of a water craft having an alternative foil assembly in accordance with the present invention.

Referring to FIG. 5, a perspective bottom view of a water craft 110 having an alternative foil assembly 140 in accordance with the present invention is shown. FIG. 5 illustrates a water craft having board 12, steering shaft 24, control handle 26 and canard 30. The water craft also has a vertical spacer 17, housing 18 (and motor and battery), and propeller as discussed elsewhere herein.

In contrast to a foil provided in sections (e.g., 13, 15 above), foil 114 may be provided as a continuous member. In the embodiment of FIG. 5, two extenders 126 extend downward and outward from housing 118. These extenders preferably have a bottom edge that is shaped to receive the top of foil 114. Leaf spring members 127 are coupled to the bottom of extenders 126 and disposed such that foil 114 may be slide into position (from the rear) between the shaped bottom of the extenders (on the top) and the leaf springs (on the bottom). Not only does this arrangement provide ease of assembly, but it permits the foil to disengage if the foil contacts an object under the water surface.

FIG. 5 also illustrates a propeller guard 123. A propeller guard may also be provided on the other embodiments disclosed herein.

Figure 6:
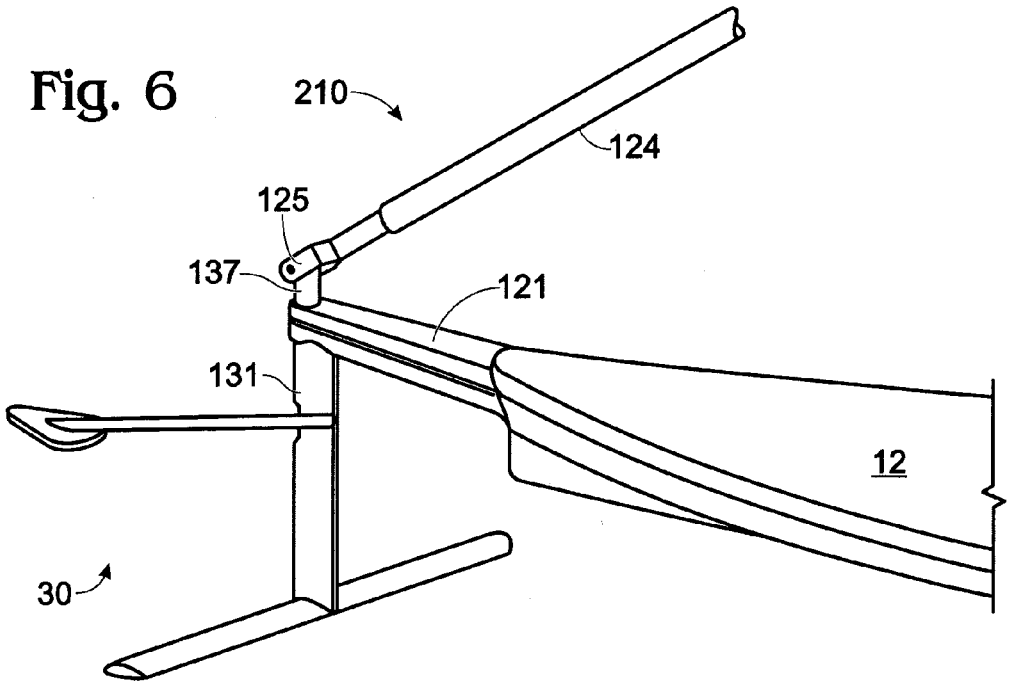
FIG. 6 is a perspective side view of the front end of a water craft having an alternative steering mechanism in accordance with the present invention is shown.

Referring to FIG. 6, a perspective side view of the front end of a water craft 210 having an alternative steering mechanism 120 in accordance with the present invention is shown. FIG. 6 illustrates board 12 and canard 30. In contrast to the embodiment of FIG. 1, however, steering shaft 124 terminates at pivot 125, where it is coupled to a shaft 137 that generally descends downward. A horizontal spacer 121 may extend from the front of board 12 to position the canard in a desired position (or to provide greater design freedom in positioning the canard). Shaft 137 is pivotally coupled to canard 30 at pivot 131, and rotatably mounted through the distal end of spacer 121.

Figure 7:
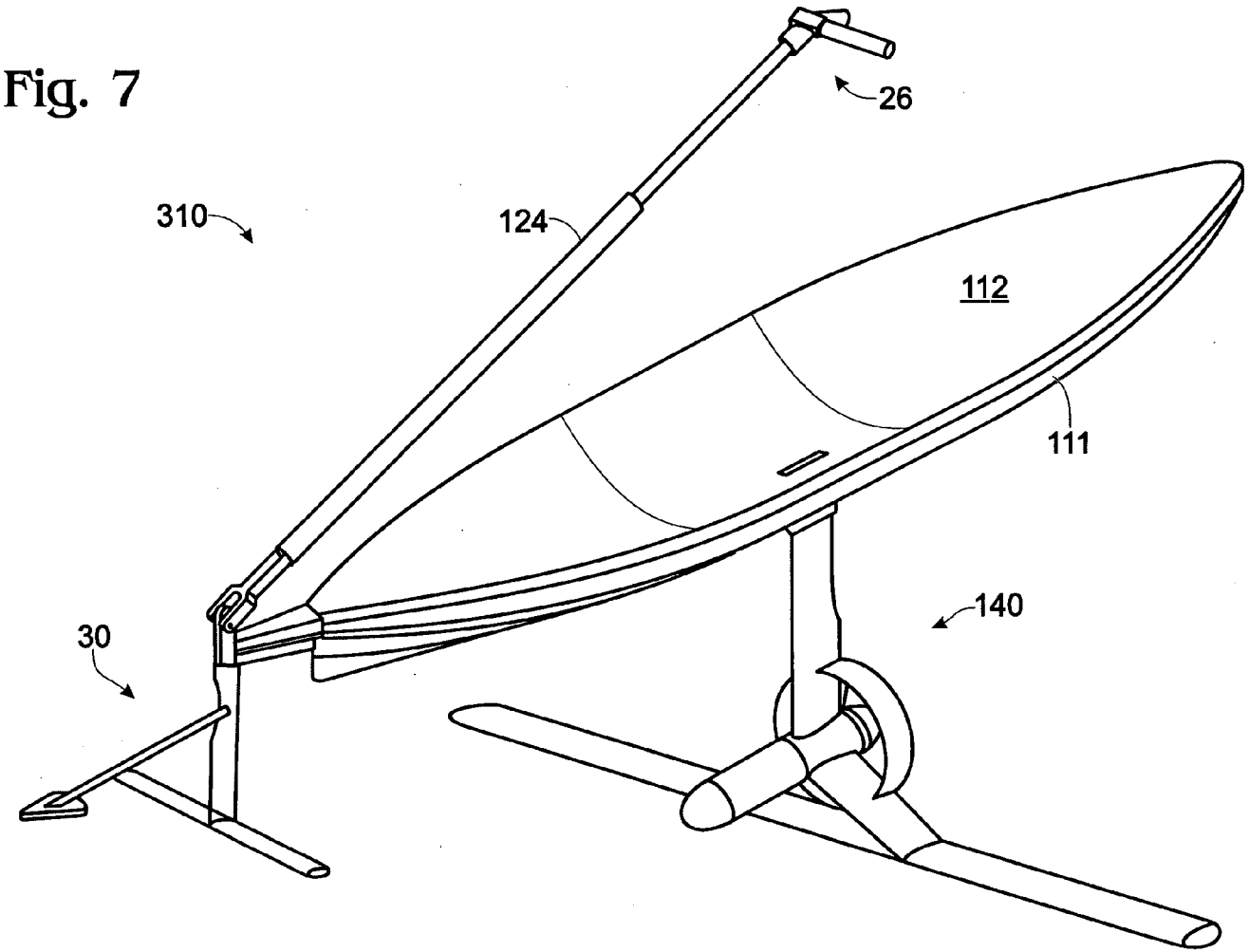
FIG. 7 is a perspective view of a water craft having an alternative flotation mechanism in accordance with the present invention.

Referring to FIG. 7, a perspective view of a water craft 310 having an alternative flotation mechanism 112 in accordance with the present invention. The flotation mechanism 112 may be formed as a kayak (open or closed) or a boat-like structure that has a hull that displaces water and supports more weight than a surfboard type flotation device as disclosed in FIG. 1. Seats or benches may be added to mechanism 112 in additional to other features and the hull 111 may be covered. The additional weight bearing properties of craft 110 would accommodate multiple people and/or gear.

FIG. 7 also illustrates a canard 30, steering shaft 124 with control handle 26 and foil assembly 140.

The foil(s) of the present invention may be made of any suitable foil material including, but not limited to lightweight corrosion resistant materials such as aluminum, aluminum alloys and other metals and alloys thereof. Plastic or other materials may also be suitable.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A motorized hydrofoil water craft, comprising:

a substantially horizontally disposed flotation board that is longer than wide and has a top surface that is configured to permit a user to lie with at least their torso on the board along a longitudinal axis thereof or to walk unimpededly thereon during use;

a first hydro foil and a second hydro foil;

a motor;

a propeller configured for submerged operation; and a steering mechanism with a control handle provided sufficiently above said board to be hand-held by a standing human using said board;

wherein said steering mechanism includes a steering shaft structure movably coupled to a forward section of said board and extending on both sides of the location of movable coupling to define:

a lower shaft portion extending forwardly to a foil structure having said first foil; and an upper shaft portion extending backwardly to said handle; and wherein operator movement through said handle of said upper shaft portion up, down, left and right produces the opposite motion respectively in said lower shaft portion, causing said board to move relative to said first foil.

2. The craft of claim 1, wherein said foil structure is coupled to the distal end of said lower shaft portion in such a way that, in use, movement of said distal end up and down does not substantially alter the orientation of the first foil in water, though changes the height of the board relative to the water.

3. The craft of claim 1, wherein said foil structure further includes a smaller, forward located surface finding foil.

4. The craft of claim 1, further comprising a vertical member that descends from said board, said foil being detachably coupled to said vertical member.

5. The craft of claim 1, wherein said upper shaft portion of said steering shaft structure is adjustable in length.

6. The craft of claim 1, wherein said control handle consists of a single handle member for one-handed control of said craft.

7. The craft of claim 1, wherein said foil structure is pivotally coupled to a distal end of said lower shaft portion, and wherein said foil structure moves pivotally in a plane that substantially includes the principal longitudinal axis of the steering shaft structure and is substantially in line with the line of direction of travel.

8. A motorized hydrofoil water craft, comprising:

a substantially horizontally disposed flotation device that has a top surface that is configured to permit a user to walk unimpededly thereon during operation of said craft;

a first foil located forward of a second foil;

a motor; and a steering mechanism including a steering shaft structure having a handle end and a foil mounting end extending forward of said handle end, a handle being coupled to said handle end and said first foil being coupled to said foil mounting end, said steering shaft structure movably coupled to said flotation device between said handle end and said foil mounting end such that operator movement of said handle end up, down, left and right produces the opposite motion respectively in said foil mounting end.

9. The craft of claim 8, wherein said handle consists of a single handle member rendering said craft operational by one hand.

10. The craft of claim 8, further comprising a front foil structure that includes said first foil and a third, smaller foil located forward of said first foil.

11. The craft of claim 8, wherein said first foil is coupled to the foil mounting end of said steering shaft structure in such a way that, in use, movement of said handle end up and down does not substantially alter the orientation of the first foil in water, though changes the height of the board relative to the water.

12. The craft of claim 8, wherein said first foil is pivotally coupled to the foil mounting end of said steering shaft structure in such a manner that the first foil moves pivotally substantially forward or backward relative to said flotation device substantially in line with the direction of travel.

13. The craft of claim 8, wherein said steering shaft structure is adjustable in length.

14. A motorized hydrofoil water craft, comprising:

a substantially horizontally disposed flotation device, configured for non-submerged operation during use;

a substantially horizontally disposed primary foil located under and spaced from said flotation device such that in use the flotation device lifts out of water by way of the lift and support provided thereto by the substantially horizontally disposed foil;

a secondary foil located forward of said primary foil;

an electric motor and battery; and a steering mechanism movably coupled to said flotation device between a first region and a second region of that steering mechanism, said first region coupling to said secondary foil and said second region coupling to an operator control handle, wherein said secondary foil and said handle are configured for movement up, down, left and right relative to said board;

wherein, in use, said secondary foil maintains substantially the same height in water while movement of the handle up or down varies the height of the board relative to the water.

15. The craft of claim 14, wherein said flotation device is longer than wide and configured to receive an adult human in the prone position.

16. The craft of claim 14, further comprising a third, surface finding smaller foil located forward of said secondary foil.

17. The craft of claim 14, wherein said secondary foil is pivotally coupled to the first region in such a manner that the secondary foil moves pivotally substantially forward or backward relative to said flotation device substantially in line with the direction of travel.

18. The craft of claim 14, wherein said primary foil is detachably coupled to said board.

19. The craft of claim 14, wherein said operator control handle consists of a single handle member for one-handed operation of the craft.

20. The craft of claim 14, wherein said second section of said steering mechanism is adjustable in length.

21. A motorized hydrofoil water craft, comprising:

a substantially horizontally disposed flotation device;

a first hydro foil;

a motor;

a canard including a second hydro foil and a smaller water surface finding foil located forward of said second hydro foil; and a steering mechanism including a steering shaft structure movably coupled to said flotation device and extending on both sides of the location of movable coupling to define:

a lower shaft portion extending forwardly to said canard; and an upper shaft portion extending backwardly to a handle; and wherein operator movement through said handle of said upper shaft portion up, down, left and right produces the opposite motion respectively in said lower shaft portion.

22. The craft of claim 21, wherein said canard is pivotally coupled to a distal end of said lower shaft portion to move substantially forward or backward relative to said flotation device substantially along the line of travel of said craft.

23. The craft of claim 22, wherein said upper shaft portion of said steering shaft structure is adjustable in length and said handle consists of a single handle member for one-handed operation of said craft.

24. A motorized hydrofoil water craft, comprising:

a substantially horizontally disposed flotation device;

a substantially horizontally disposed first foil and a second foil, the second foil being located forward of said first foil;

an electric motor and battery;

a steering mechanism movably coupled to said flotation device between a first region and a second region of that steering mechanism, said first region coupling to said second foil and said second region coupling to an operator control handle, wherein said second foil and said handle are configured for movement up, down, left and right relative to said board, and wherein, in use, said second foil maintains substantially the same height in water while movement of the handle up or down varies the height of the flotation device relative to the water; and a vertical member that descends from said board and is coupled to said first foil and maintains said first foil at a given distance from said board.

* * * * *